US006097907A

United States Patent [19]

Fujiwara

[11] Patent Number: 6,097,907

[45] Date of Patent: Aug. 1, 2000

[54] DEVELOPER CONTAINER, PROCESS CARTRIDGE, DEVELOPER SEALING MEMBER AND SEALING METHOD

[75] Inventor: Yasuo Fujiwara, Kashiwa, Japan

[73] Assignee: Canon Kabushiki Kaisha, Tokyo, Japan

[21] Appl. No.: 08/939,678

[22] Filed: Sep. 29, 1997

[30] Foreign Application Priority Data

Oct. 2, 1996 [JP] Japan ..... 8-261576

[51] Int. Cl.[7] ..... G03G 15/08

[52] U.S. Cl. ..... 399/106; 399/103

[58] Field of Search ..... 399/98, 102, 103, 399/105, 106, 109, 111, 119, 262; 428/343, 347, 355 R, 355 BL

[56] References Cited

U.S. PATENT DOCUMENTS

| | | | |
|---|---|---|---|
| 4,827,307 | 5/1989 | Zoltner | 399/106 |
| 4,977,003 | 12/1990 | Brown et al. | 428/343 X |
| 5,177,540 | 1/1993 | Honda et al. | 399/106 |
| 5,258,814 | 11/1993 | Davies | 399/105 |
| 5,273,797 | 12/1993 | Hazelton et al. . | |
| 5,460,674 | 10/1995 | Chitouras | 399/106 X |
| 5,491,542 | 2/1996 | Nagashima et al. | 399/106 |
| 5,585,902 | 12/1996 | Nishiuwatoko et al. | 399/106 |
| 5,689,772 | 11/1997 | Fujiwara et al. . | |
| 5,724,631 | 3/1998 | Nakao | 399/103 |

FOREIGN PATENT DOCUMENTS

| | | |
|---|---|---|
| 0638851 A3 | 2/1995 | European Pat. Off. . |
| 0651297 A1 | 5/1995 | European Pat. Off. . |
| 1-223485 | 9/1989 | Japan . |
| 3-039763 | 2/1991 | Japan . |
| 7-056428 | 3/1995 | Japan . |

OTHER PUBLICATIONS

Pat. Abs. Jap., vol. 095, No. 002, Mar. 1995 (JP 06 308 783).

*Primary Examiner*—Sandra Brase

*Attorney, Agent, or Firm*—Fitzpatrick, Cella, Harper & Scinto

[57] ABSTRACT

A developer container having an opening for discharging a developer contained therein and a sealing surface portion surrounding the opening, is sealed with a sealing member having a sealant layer and applied onto the sealing surface portion of the developer container with the sealant layer. The sealant layer contains a dispersed material therein and the sealing surface portion of the developer container contains a dispersed material, which is mutually soluble with the dispersed material in the sealant layer. The dispersed material in the sealant layer preferably includes a thermoplastic elastomer. The resultant sealed developer container may be provided with a sound seal structure even at a relatively low sealing pressure causing a smaller sealing surface depression of the developer container, which allows re-sealing of the container.

24 Claims, 9 Drawing Sheets

DEVELOPER CONTAINER, PROCESS CARTRIDGE, DEVELOPER SEALING MEMBER AND SEALING METHOD

FIELD OF THE INVENTION AND RELATED ART

The present invention relates to a developer container for replenishing a developer for a developing apparatus to an image forming apparatus, such as an electrophotographic copying machine or printer, a process cartridge, and a developer sealing member for such a developer container.

Hitherto, electrophotographic image forming apparatus have been extensively used as a printer, a copying machine, etc.

Such an electrophotographic image forming apparatus is equipped with a developing apparatus containing a developer, and the developer is consumed as the image forming cycles are repeated, so that a developer replenishment to the developing apparatus has to be performed at an appropriate time. The developer replenishment is usually performed by using a developer container, which is used not only for replenishing the developer for a copying machine, etc., at a time but also as a toner container of a process cartridge for use in printers for terminal apparatus in data processing apparatus, such as computers, facsimile apparatus and CAD apparatus.

The developer container has been frequently formed from a material, such as high-impact polystyrene (HIPS) or acrylonitrile-butadiene-styrene copolymer, and the opening or aperture thereof is sealed by a sealing member, such as an easy peel film or a tear seal member comprising a cover film and a tear tape, respectively having a sealant layer generally comprising polyethylene and ethylene-vinyl acetate copolymer.

For the sealing, the sealing member is applied onto a flange surface provided with the opening of the developer container by heat-sealing or impulse heat-sealing.

However, the use of such a conventional developer container has been accompanied with the following problems:

(1) As the developer container size has been enlarged in recent years, a higher degree of pressure-resistant sealing performance (hereinafter simply referred to as "sealing performance") is desired.

(2) In recent years, the developer container has been sometimes composed of materials, other than conventional materials of HIPS and ABS, including HIPS of UL-flame-retarding V2-grade containing a flame retardant and a plastic material containing a release agent, such as a metal stearate, i.e., materials containing substances which are liable to inhibit the sealing performance.

(3) A sealing member is ordinarily applied directly onto a sealing surface of a developer container while ensuring a sealing surface fit. However, depending on the molding process of the developer container, such a direct application cannot be performed in some cases and, in such a case, the sealing is performed on a separate part which is thereafter integrated with the developer container. This results in an increase in costs of such parts and integration operation.

(4) When a developer container once used is intended to be re-used by re-sealing on the same sealing surface of the developer container, the seal bar has to be impressed or penetrated into the sealing surface with a seal bar penetration (or a sealing surface depression) of ca. at least 10 $\mu$m in view of the property of the sealing member in the first sealing, and the resultant uneven sealing surface obstructs a uniform sealing surface fit in the re-sealing, so that the once-used developer container cannot be re-used by re-sealing on the same sealing surface.

SUMMARY OF THE INVENTION

An object of the present invention is to provide a developer container with excellent sealing performance.

Another object of the present invention is to provide a process cartridge including such a developer container with excellent sealing performance.

Another object of the present invention is to provide a developer container having sufficient sealing performance, even if it has a structure incapable of direct application of a sealing member, and a sealing method for providing such a developer container.

Another object of the present invention is to provide a developer sealing member allowing re-sealing onto an identical surface of a developer container.

Another object of the present invention is to provide a method of re-utilizing a developer container by using such a developer sealing member.

According to the present invention, there is provided a sealed developer container for containing a developer, comprising: a developer container having an opening and a sealing surface portion surrounding the opening, and a sealing member having a sealant layer and applied onto the sealing surface portion of the developer container with the sealant layer; wherein the sealant layer contains a dispersed material therein and the sealing surface portion of the developer container contains a dispersed material which is mutually soluble with the dispersed material in the sealant layer.

According to the present invention, there is provided a process cartridge detachably mountable to a main assembly of an image forming apparatus, including at least a sealed developer container containing a developer; the selected developer container comprising: a developer container having an opening and a sealing surface portion surrounding the opening, and a sealing member having a sealant layer and applied onto the sealing surface portion of the developer container with the sealant layer; wherein the sealant layer contains a dispersed material therein and the sealing surface portion of the developer container contains a dispersed material which is mutually soluble with the dispersed material in the sealant layer.

According to the present invention, there is provided a method of sealing a developer container for containing a developer, comprising:

providing a sealing member having a sealant layer containing a dispersed material therein;

providing a developer container having an opening and a sealing surface portion surrounding the opening, the sealing surface portion containing a dispersed material which is mutually soluble with the dispersed material in the sealant layer of the sealing material, and applying the sealing member with its sealant layer onto the sealing surface portion of the developer container so as to cover the opening of the developer container under application of a sealing pressure onto the sealing surface portion of the developer container via the sealing member while not supporting the sealing pressure at a surface opposite to the sealing surface of the developer container.

The present invention further provides a method of re-utilizing a developer container for containing a developer therein, comprising:

providing a developer container having an opening and a sealing surface portion surrounding the opening, providing a sealing member having a sealant layer containing a thermoplastic elastomer dispersed therein, applying the sealing member onto the sealing surface portion of the developer container under application of a sealing pressure onto the sealing surface via the sealing member in a first sealing step to provide a sealed developer container filled with a developer, cleaning the sealing surface after removing the sealing member for discharging the developer contained therein, and again applying a similar sealing member onto the cleaned sealing surface of the developer container under application of a sealing pressure in a subsequent sealing step, wherein the first sealing step is performed while controlling the sealing pressure to provide a sealing surface depression within a range of 5–50 $\mu$m.

In the sealed developer container, the dispersed material in the sealant layer of the sealing member has a mutual solubility with the dispersed material contained in the sealing surface portion of the container, so that both dispersed materials mutually dissolve each other at the seal boundary under application of heat and pressure during heat sealing to provide a bonding force, which is added to an adhesive force acting between the sealant layer and the sealing surface of the container, thereby providing a good sealing performance without impairing the easy peel characteristic of the seal.

Further, owing to such a bonding force, even in a container structure incapable of directly supporting a sealing pressure on the back surface opposite to the sealing surface, it is possible to provide a sealed developer container exhibiting a sufficient sealing performance and also such a sealing method.

Further, a preferred embodiment of developer sealing member contains a thermoplastic elastomer as the dispersed material in the sealant layer, which can effectively prevent the seal peeling and provide an improvement in impact strength (pressure-resistant sealing performance) at low temperatures which has been insufficient in a conventional seal, because of an enhanced elasticity of the sealant layer in response to an instantaneous impact applied to the seal during circulation or transportation of the developer container, even in case where the sealing surface portion of the container does not contain a mutually soluble dispersed material. Further, in the step of bonding the sealing member and the sealing surface of the container under application of heat and pressure, the penetration of the sealant layer into the sealing surface portion of the container can be suppressed due to the elasticity of the thermoplastic elastomer in the sealant layer, thereby facilitating re-utilization of the container.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
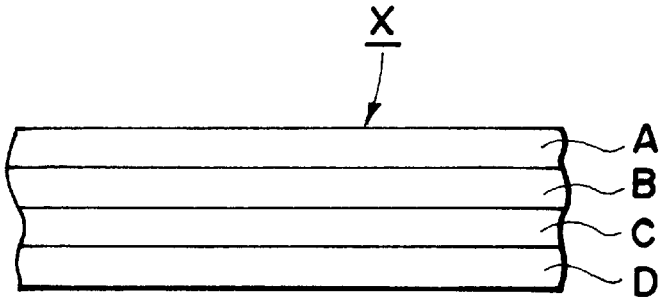
FIG. 1 is a partial sectional view of an embodiment of the developer sealing member according to the invention.
Figure 2:
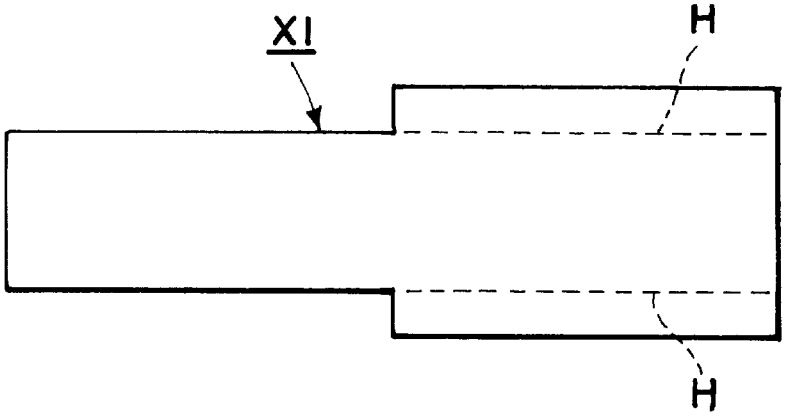
FIG. 2 is a plan view of a tear sealing member according to the present invention.

A developer container may include a container for toner particles constituting a mono-component type developer, and a container for toner particles and/or carrier particles in the case of a two-component type developer. The developer container may also be called a toner container in the following description.

The developer sealing member according to the present invention basically comprises a substrate and a sealant layer formed thereon. The substrate may comprise a film of various resins, such as polyester, polypropylene, polyethylene, polyamide, polyimide and polycarbonate.

The sealant layer formed on the substrate may preferably contain a dispersed material comprising a thermoplastic elastomer, examples of which may include styrene(-type) elastomers, olefin(-type) elastomers, urethane(-type) elastomers, ester(-type) elastomers and amide(-type) elastomers.

Herein, a "thermoplastic elastomer" means a resinous material which can be processed and shaped similarly as a thermoplastic resin but has a rubber elasticity as represented by a reversible elongation strain of at least 50%, preferably at least 100%, at room temperature.

A preferred class of a thermoplastic elastomer may have a molecular structure including a soft segment having a rubber elasticity and a hard segment (molecular-constraining segment) corresponding to a crosslinking point of a vulcanized rubber and exhibiting an effect of preventing plastic deformation and imparting a reinforcing effect. The hard segment is plasticized upon heating and is re-hardened upon cooling.

The hard segment and the soft segment may preferably be contained in the thermoplastic elastomer in a weight ratio of 80:20–20:80.

By dispersing such a thermoplastic elastomer in the sealant layer, it becomes possible to improve the dynamic viscoelasticity of the entire sealant layer over a wide temperature environment, thereby effectively preventing a sealing failure (peeling) in response to an instantaneous impact against the seal (structure) during transportation and providing excellent impact resistance at low temperatures and a sufficient sealing performance for a large-sized developer container or a developer container comprising a flame-retardant material of UL-V2-grade liable to provide a poor seal structure.

Now, a brief explanation will be made of the behavior of this seal and such excellent dynamic visco-elasticity over a wide temperature range of SBS-copolymer elastomer as an example of a thermoplastic elastomer.

SBS copolymer comprises hard segments of polystyrene (PS) and a soft segment of polybutadiene (PB) and, in the sealant layer, PS is present as microscopically phase-separated PS domains, and the respective PS domains physically bond with PB blocks to form a block copolymer. In the copolymer, the PB segment shows a low Tg (glass transition temperature) and the PS segment shows a high Tg, whereby the elastomer exhibits a temperature region (rubbery plateau region) where the elastomer does not show a flow state or cause a substantial change in elasticity. If the temperature range of circulation or transportation (e.g., −20° C. to 50° C.) is designed to correspond to the temperature region, a good developer sealing performance can be retained due to the elastomeric property of the sealant layer.

Several classes of thermoplastic elastomers suitably used in the present invention are enumerated hereinbelow.

Examples of styrene(-based) elastomers may include one comprising a hard segment of polystyrene (PS) and a soft segment of polybutadiene (PB) or polyisoprene, one comprising a hard segment of PS and a soft segment of hydrogenated polybutadiene, one comprising a hard segment of PS and a soft segment of hydrogenated polyisoprene, and one comprising a hard segment of PS and a soft segment of hydrogenated PS-butadiene rubber.

Examples of olefin(-based) elastomers may include one comprising a hard segment of polyethylene (PE) or polypropylene (PP) and a soft segment of hydrogenated PS-butadiene rubber, and one comprising a hard segment of PE or PP and a soft segment of ethylene-propylene-based rubber.

Examples of urethane(-based) elastomers may include one comprising a hard segment including a urethane structure and a soft segment of polyester or polyether.

Examples of ester(-based) elastomers may include: one comprising a hard segment of polyester and a soft segment of polyether or polyester.

Examples of amide(-based) elastomers may include: one comprising a hard segment of polyamide and a soft segment of polyether or polyester.

It is also preferred to use polybutadiene having a crystalline portion functioning as a hard segment, and an amorphous portion functioning as a soft segment, such as syndiotactic 1,2-polybutadiene having a crystallinity of 10–40%.

At least one species selected from the above-enumerated thermoplastic elastomers may be used as a preferable dispersed material in the sealant layer. It is further preferred to use a styrene elastomer comprising a combination of a hard segment of PS and a soft segment of hydrogenated polybutadiene or hydrogenated polyisoprene (SBS copolymer or SIS copolymer), or a combination of a hard segment of PS and a soft segment of hydrogenated styrene-isoprene-styrene block copolymer (SIS copolymer).

By hydrogenating a thermoplastic elastomer such as SBS copolymer or SIS copolymer, the thermoplastic elastomer can be easily uniformly dispersed and mixed in the sealant layer without impairing the excellent dynamic viscoelasticity of the thermoplastic elastomer, whereby it becomes possible to uniformize and stabilize the excellent viscoelasticity of the entire sealant layer over a broad temperature range.

The above-mentioned thermoplastic elastomer may be dispersed in a matrix or binder comprising a thermoplastic resin, examples of which may include: ethylene-vinyl acetate copolymer (EVA), polyethylene resins, such as low-density polyethylene (LDPE), very low-density polyethylene (VLDPE), linear low-density polyethylene (LLDPE), non-stretched polypropylene (CPP), polyester (PET), polyacrylonitrile (PAN) and ethylene-vinyl alcohol copolymer (EVOH).

The dispersed material represented by such a thermoplastic elastomer may preferably be dispersed in an amount of 0.5–30 wt. % of the resultant sealant layer.

The developer container may basically comprise a shaped body of any plastic material but may preferably comprise a shaped body of a thermoplastic resin, particularly an impact-resistant thermoplastic resin, such as impact-resistant polystyrene (HIPS), acrylonitrile-butadiene-styrene copolymer (ABS), or polycarbonate/acrylonitrile-butadiene-styrene copolymer (PC-ABS). It is also possible to use polyphenylene oxide (PPO) or modified PPO, particularly one containing HIPS as a modifying component.

At least a sealing surface portion of the developer container may preferably contain a dispersed material which is mutually soluble with the dispersed material, preferably a thermoplastic elastomer, dispersed in the sealant layer of the sealing member.

Herein, the mutual solubility of the dispersed material in the sealing surface portion of the developer container with the dispersed material in the sealant layer may be confirmed by a bonding of both types of dispersed materials (particles) while removing or destroying at least a part of the boundary therebetween at the sealing boundary between the sealant layer and the sealing surface of the developer container. Such a bonding state may also be confirmed by a stretching of either dispersed material at a broken seal boundary (as shown at a lower part in FIG. 15).

So as to satisfy the mutual solubility requirement, the dispersed material in the sealing surface portion of the developer container may preferably be a material comprising a polymerized chemical species identical to that providing a soft segment of the thermoplastic elastomer in the sealant layer, such as polymerized units of butadiene, isoprene or ethylene-propylene blocks.

For example, the above-mentioned impact-resistant thermoplastic resin constituting the developer container already contains polymerized butadiene particles as impact resistance-imparting particles having a good mutual solubility with a polymerized butadiene segment-containing thermoplastic elastomer in the sealant layer.

Hereinbelow, the present invention will be described more specifically based on embodiments while referring to the drawings.

FIG. 1 is a partial sectional view of a developer sealing member X according to an embodiment of the present invention. Referring to FIG. 1, the sealing member X has a multi-layer laminate structure including a first substrate A, a second substrate B, a cushioning layer C and a sealant layer D.

The first substrate A may for example comprise a ca. 10–30 μm-thick biaxially stretched polyester film, uniaxially stretched polypropylene film, or stretched polyamide film. If the substrate A comprises a moisture-absorptive film, it is liable to be curled to lower the heat-sealing processability, so that a biaxially stretched polyester film or a uniaxially stretched polypropylene film is preferred, and a biaxially stretched polyester film is most preferred in view of the film strength.

The second substrate B may preferably comprise a ca. 10–30 μm-thick stretched polyamide layer or a biaxially stretched polyester film of a similar thickness so as to provide the sealing member X with elongation strength (toughness).

The second substrate B may be provided with a printed mark, such as an arrow for clearly indicating a direction for taking off the seal of the developer container to the users. In case where such printing is not provided, one of the substrates A and B can be omitted.

The cushioning layer C may, for example, comprise a ca. 10–30 μm-thick layer of polyethylene which may preferably have a relatively low molecular weight of, e.g., ca. 10,000 so as to provide a large cushioning effect at the time of heat sealing.

The sealant layer D may comprise a matrix of a thermoplastic resin containing a dispersed material, respectively, as described above. In a specifically preferred embodiment, the matrix of the sealant layer D may comprise ethylene-vinyl acetate copolymer (EVA) having a vinyl acetate content of 3–20 wt. % or a blend of polyethylene and 3–20 wt. % of ethylene-vinyl acetate copolymer (EVA).

In order to prevent the blocking (i.e., undesirable bonding) with surrounding members of the sealant layer D after the sealing member X is applied onto a developer container for sealing, particularly in a high temperature—high humidity environment, the VA (vinyl acetate) content may preferably be suppressed to at most 10 wt. % of the resultant sealant layer.

For obviating the blocking, it is also preferred to use EVA which has a molecular weight distribution according to gel permeation chromatography (GPC) showing at least one peak in a molecular weight region of at least $10^5$ and showing no peak in a region of molecular weight below $10^5$.

As described above, the sealant layer D contains a dispersed material, which may preferably be a thermoplastic elastomer, and optionally a tackifier and/or a slipping or release agent, as desired, so as to provide a good balance between sealing performance and easy peelability.

In view of such a good balance between sealing performance and easy peelability (seal breakability), the sealant layer may preferably have a thickness of ca. 30–50 μm, more preferably ca. 40–50 μm.

The sealing member X may for example be prepared by laminating the first substrate A and the second substrate B, and bonding the laminate A/B with the sealant layer D with a melted cushioning layer C to form a laminate structure as shown in FIG. 1, which is thereafter cooled and wound up into a roll.

As described above, a developer container to be sealed with a sealing member as described above may comprise any plastic material, including ABS, HIPS, polyphenylene oxide (PPO), modified PPO, etc. It is also possible to use HIPS of UL-V2 level of a flame retarding grade.

Figure 4:
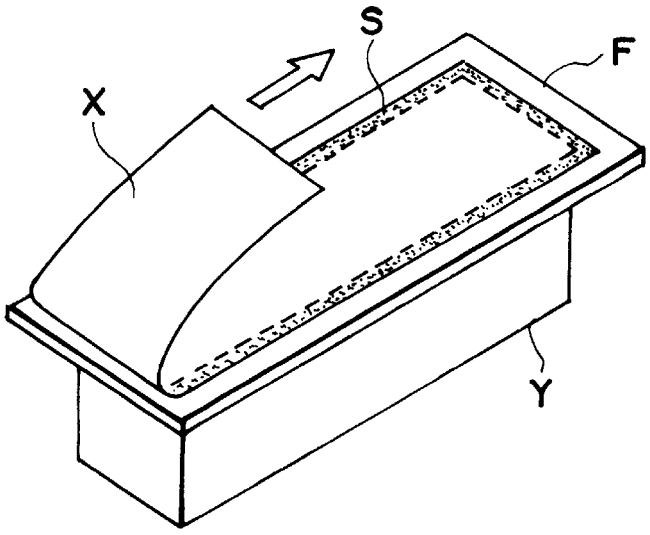
FIG. 4 is a perspective view of an embodiment of the developer container according to the invention.

Such a sealing member X may be applied by heat-sealing onto a sealing surface S provided at a flange portion F of a developer container Y as described above in a manner as shown in FIG. 5 to provide a sealed developer container as shown in FIG. 4.

Figure 6:
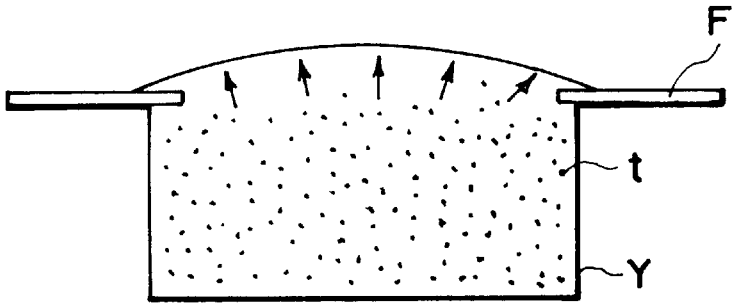
FIG. 6 is a sectional view showing a state of a developer container sealed with a developer sealing member.

In this instance, the seal width on the sealing surface S, i.e., the width of a seal bar 101 connected to a seal horn 100, is required to have a substantial width, desirably for example ca. 2–4 mm, so as to provide a sufficient seal strength by which the developer or toner t in the container Y is ensured to be sealed up within the container in resistance to an impact as by dropping or a pressure as shown in FIG. 6.

The heat-sealing of the sealing member X onto a developer container Y may be performed by ordinary heat-sealing, impulse heat sealing, etc.

Figure 7:
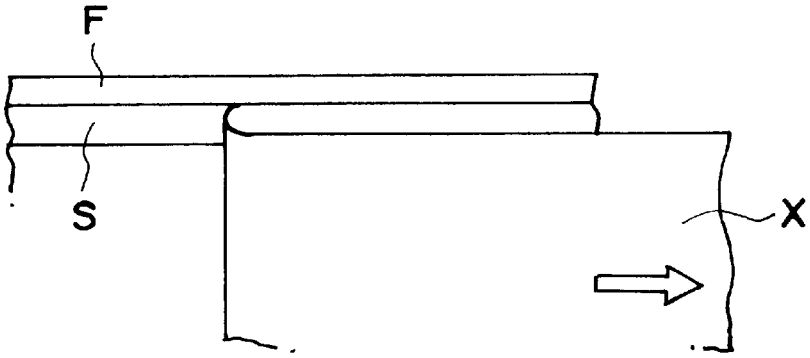
FIG. 7 is an illustration of a manner of breaking a developer seal.

When the developer container after the heat-sealing of the sealing member X on the developer container Y is used for replenishment of a developer, the sealing member X is broken by pulling it as shown in FIG. 7. At this time, care should be taken so as not to leave any sealant residue on the seal-peeled surface of the toner container. Such a sealant residue, when left, can contaminate the developer t in the container Y, thus resulting in image defects, such as white streaks in the developed images.

Figure 8:
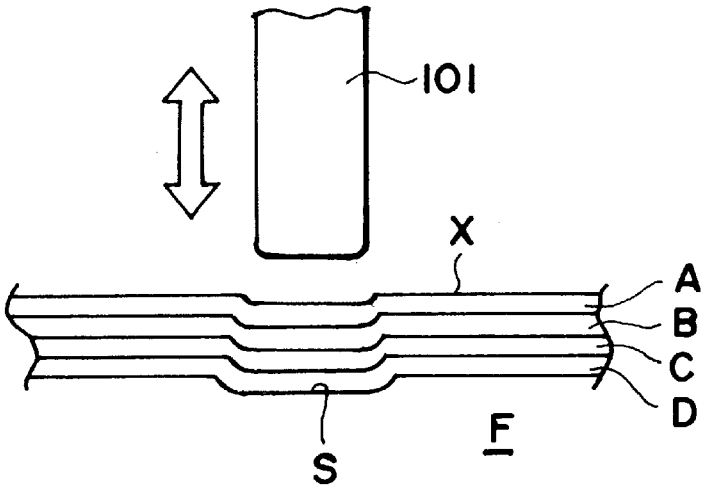
FIG. 8 is an illustration of a manner of subjecting a developer sealing member to heat-sealing.

For this purpose, in addition to the control of the material and the thickness of the sealant layer D, it is important to control the application of heat and pressure exerted by a seal bar 101 at the time of heat-sealing as shown in FIG. 8.

For example, if the sealing pressure, temperature and time are excessive, a depression of the sealing surface S of the developer container Y which is ordinarily on the order of 0.1–0.5 mm, may be increased to ca. 1 mm, whereby the sealant layer D may gush out of the edge of the seal bar 101 to form a sealant line to cause a sealant residue after breakage of the seal. Accordingly, the heat-sealing conditions have to be adequately set so as not to cause an excessive depression.

In the above-described embodiment, a sealing member having a four-layer structure has been described, but the sealing member according to the present invention can be formed in a three-layer structure including only one layer of substrate or a two layer structure by further omitting the cushioning layer C, as far as it includes a sealant layer as defined above.

Further, the sealing member according to the present invention can also be constituted as a single sheet of tear-type sealing member X1, which includes a tearable portion bounded by half-cut processed line H and covering an opening of the developer container, so as to provide an inexpensive sealing member.

Figure 3:
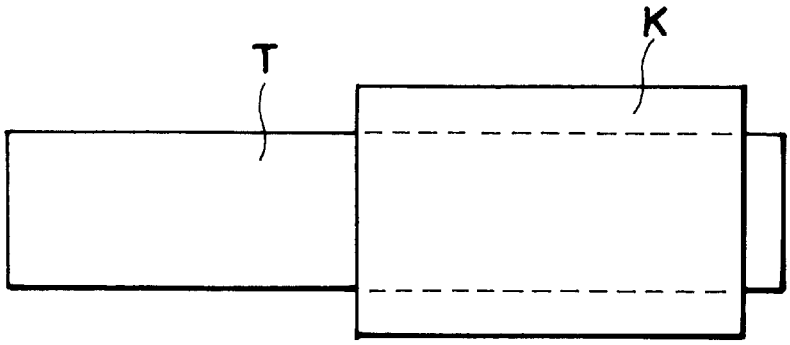
FIG. 3 is a tear sealing member including a developer sealing member, according to the invention, as a tear tape.

The sealing member can also be constituted as a tear-type sealing member as shown in FIG. 3 including a tear tape T and a cover film K as disclosed in JP-A 1-223485, JP-A 3-39763 and JP-A 7-56428. In this case, the tear tape may have a structure of the sealing member according to the present invention.

The resultant sealed developer container Y having a structure as shown in FIG. 4 may be incorporated in a process cartridge, which per se is well known. As the sealed developer container exhibits a very good sealing performance, it provides an effective means of preventing leakage of developer (toner) during circulation or transportation of a large-sized process cartridge.

For easy re-utilization of the developer container by peeling the seal of the used developer container and re-sealing, followed by re-filling the developer container with a developer, it is preferred to adopt heat-sealing conditions including a sealing temperature of 110–140° C., a sealing surface pressure of 5–20 kg.f/cm$^2$ and a sealing time of 1–3 sec. so as to provide a sealing surface depression of 5–50 $\mu$m. This is suitable in view of cleanability of the sealing surface before the re-sealing and sealing performance of the seal provided by the re-sealing.

EXAMPLE 1

A developer sealing member X having a laminate structure as shown in FIG. 1 was prepared. More specifically, the sealing member included a 16 $\mu$m-thick biaxially stretched polyester film (substrate A), a 25 $\mu$m-thick stretched polyamide film (substrate B), a 30 $\mu$m-thick layer of polyethylene having a molecular weight of ca. 10,000 (cushioning layer C), and a 40 $\mu$m-thick sealant layer D formed from the following composition:

| | |
|---|---|
| EVA (vinyl acetate content = 7 wt. %) | 74.0 wt. part(s) |
| Petroleum resin (tackifier) | 0.039 wt. part(s) |
| Irganox* (anti-oxidant) (*n-octadecyl-8-(4'-hydroxy-3',5'-di-t-butylphenyl)propionate) | 0.109 wt. part(s) |
| Erucic acid amide (slipping agent) | 0.230 wt. part(s) |
| Styrene-ethylene-butadiene-styrene elastomer (SEBS) | 7.4 wt. part(s) |

The EVA used provided a GPC molecular weight distribution showing no peak in a molecular weight region of below $10^5$ and showing a single peak at a molecular weight of $1.54\times10^5$.

Figure 9:
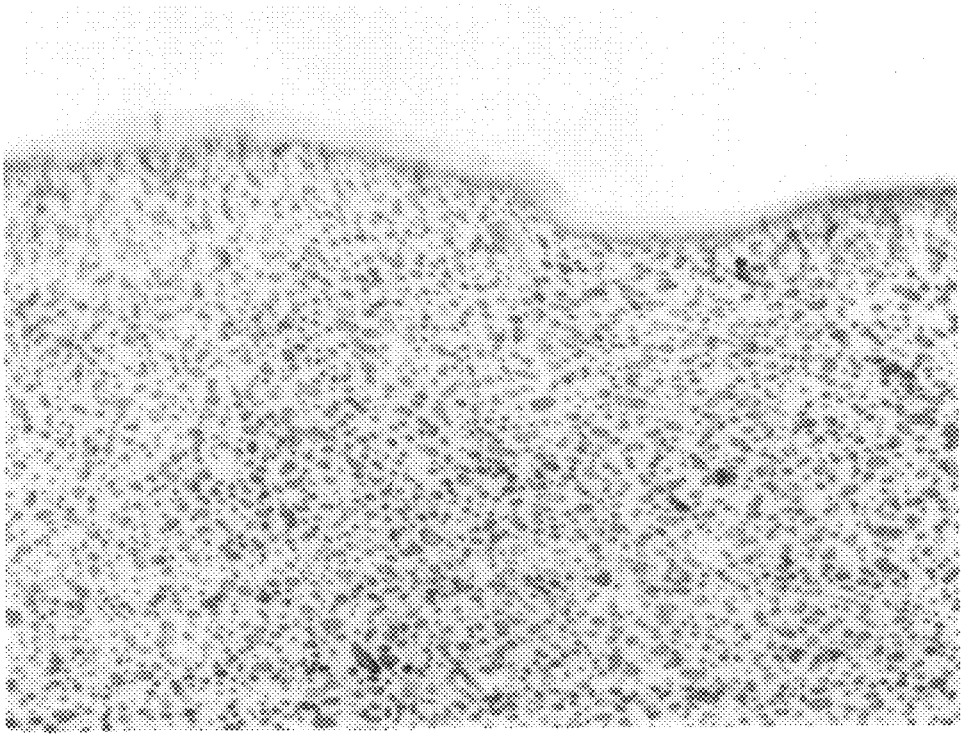
FIGS. 9 and 10 are TEM (transmission electron microscope) photographs of sliced sealant layer sections perpendicular and parallel, respectively, to the extruded direction of the sealant layer of a developer sealing member according to Example 1 described hereinafter.
Figure 10:
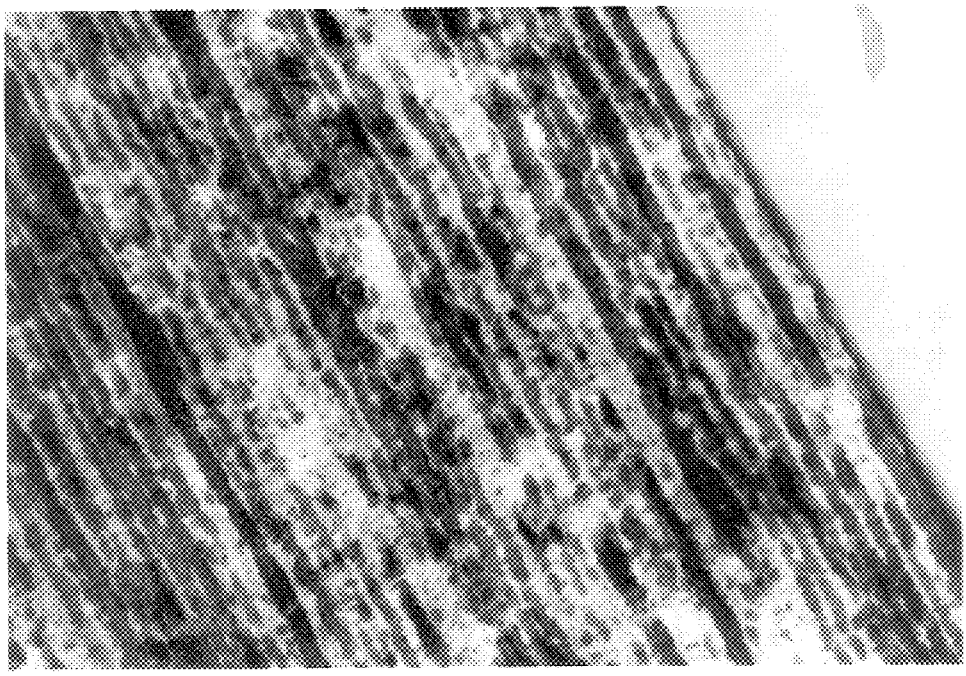

A sliced section perpendicular to the extruded direction of the sealant layer D was dyed with rubidium and photographed through a transmission electron microscope (TEM) to provide a photograph (FIG. 9, magnification=$2\times10^4$). FIG. 10 is a TEM photograph (magnification=$4\times10^4$) of a section parallel to the extruded direction of the sealant layer D. In each figure, black spots (FIG. 9) or bars (FIG. 10) represent SEBS particles as the dispersed material. The dispersed SEBS particles generally exhibited shapes of bars having a thickness of 0.02–0.2 $\mu$m.

Separately, a large-sized developer container Y, having a shape roughly as shown in FIG. 4 and sizes including an opening width of 70 mm and an inner volume of 1000 cc for containing 500 g of a magnetic toner, was formed by injection molding of HIPS containing polybutadiene particles (average particle size=0.65 $\mu$m) and containing 1.3 wt. % of stearic acid salt and 1.6 wt. % of inorganic flame retardant.

Figure 11:
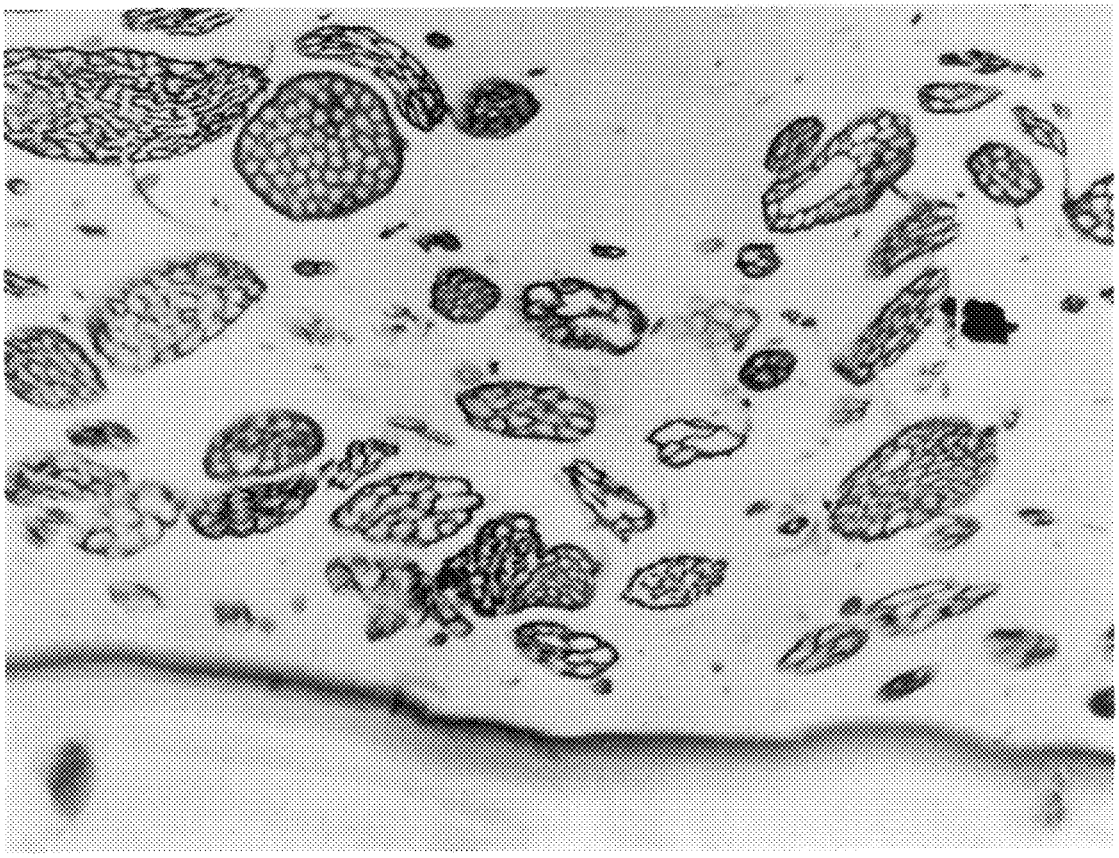
FIG. 11 is a TEM photograph of a sliced section of a developer container of HIPS according to Example 1.

FIG. 11 is a TEM photograph ($\times2\times10^4$) of a sealing surface portion of the developer container showing a state of dispersion of the polybutadiene particles (mesh-like islands) having particle sizes of 0.1–1 $\mu$m in the sea (or matrix) of PS appearing as a white background.

Figure 5:
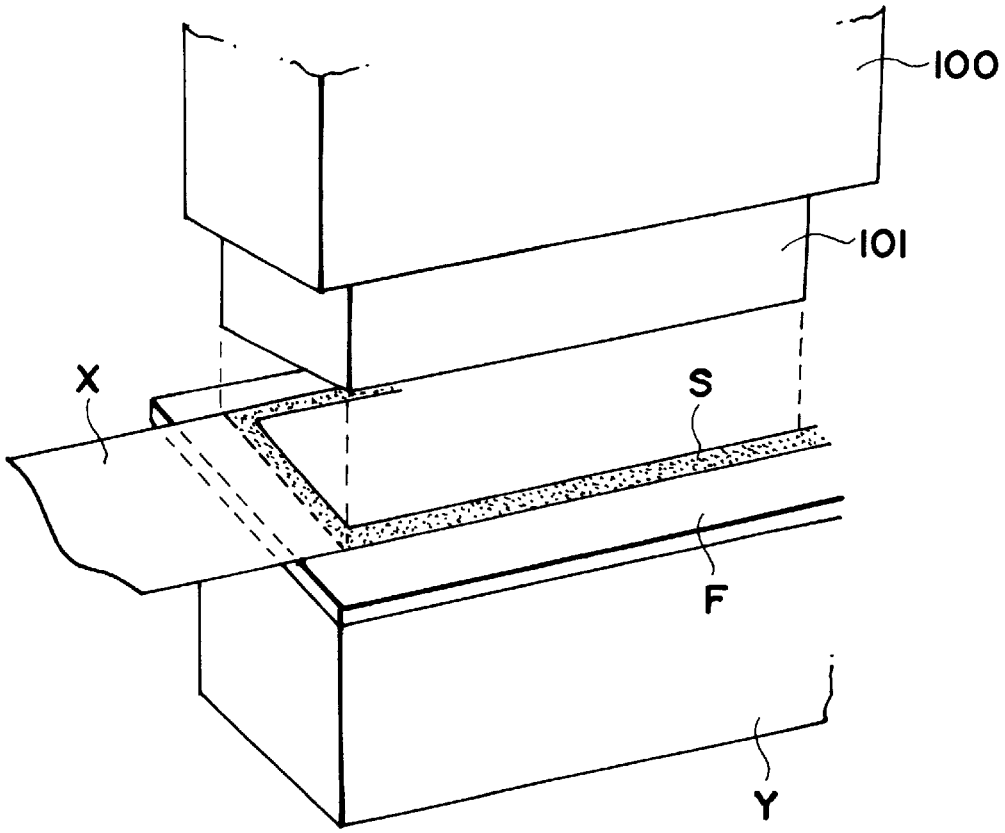
FIG. 5 is a perspective view for illustrating a manner of heat-sealing a developer container with a developer sealing member.
Figure 12:
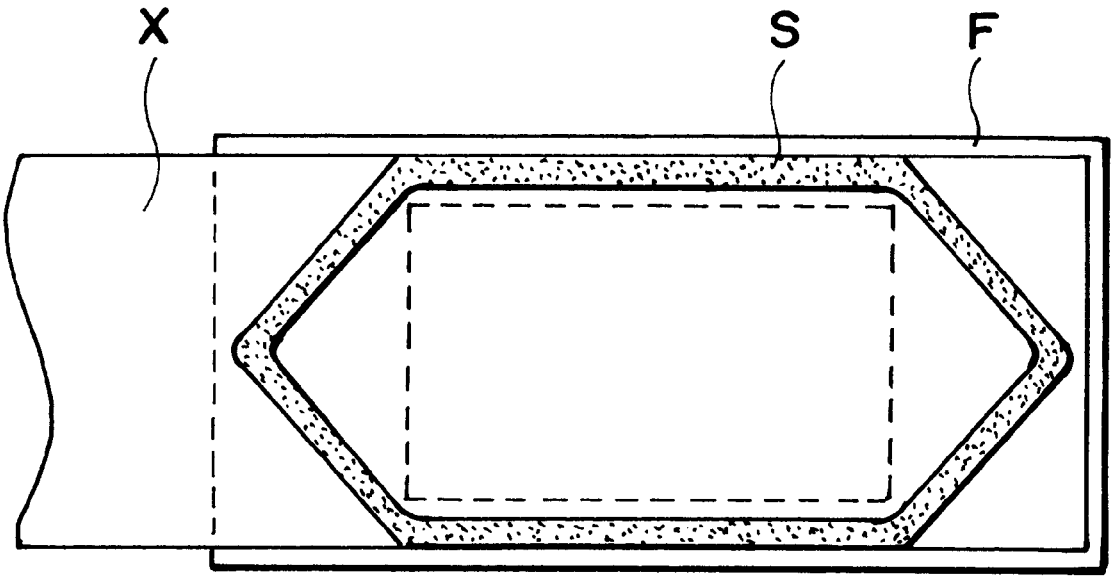
FIG. 12 is a plan view showing a developer seal pattern according to Example 1.

The above-prepared developer sealing member was applied by heat-sealing at a sealing surface portion S prescribed on a flange F of the above-prepared developer container Y in a seal pattern S as shown in FIG. 12 including angularly projected leading and trailing ends so as to suppress a seal-breaking strength and having a width of seal S of 3 mm corresponding to the width of the seal bar 101 (FIG. 5). The heat-sealing conditions included a temperature of 130° C., a pressure of 10 kg.f/cm$^2$, and a sealing time of 2 sec., whereby the sealing surface depression was ca. 10 $\mu$m.

Figure 13:
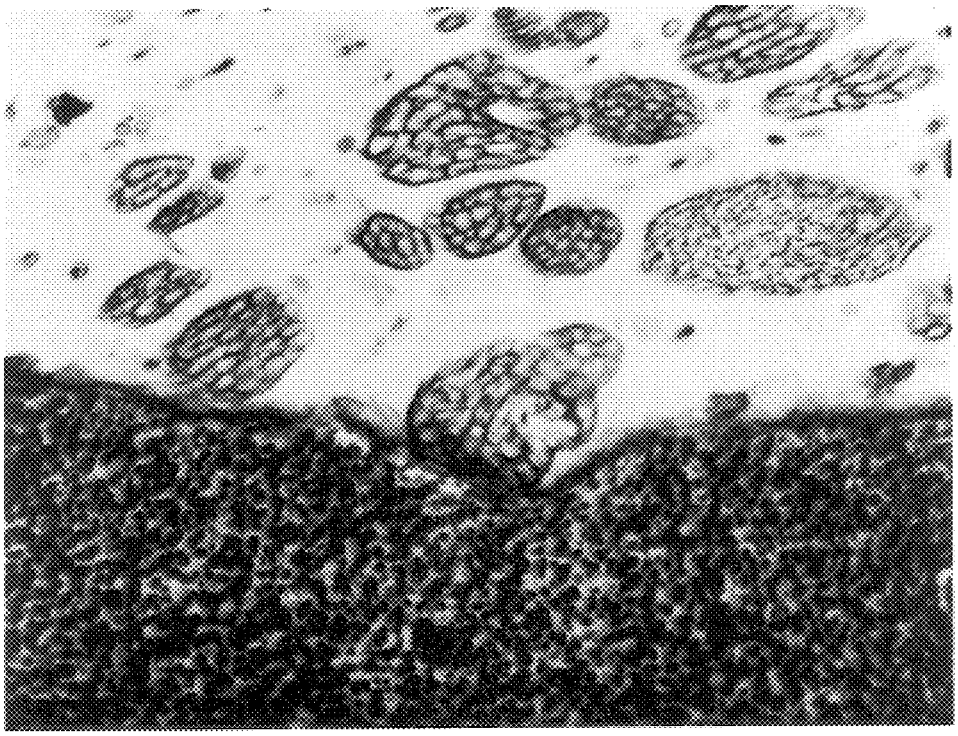
FIG. 13 is a TEM photograph of a sliced seal boundary showing a mutually dissolved and bonded state of a dispersed material in the sealant layer and a dispersed material in the sealing surface portion of the developer container according to Example 1.

FIGS. 13 ($\times2\times10^4$) and 14 ($\times10^5$) are TEM photographs of the resultant heat seal boundary (between the upper portion of HIPS containing dispersed polybutadiene particles and the lower portion of the sealant layer containing dispersed SEBS particles).

Figure 14:
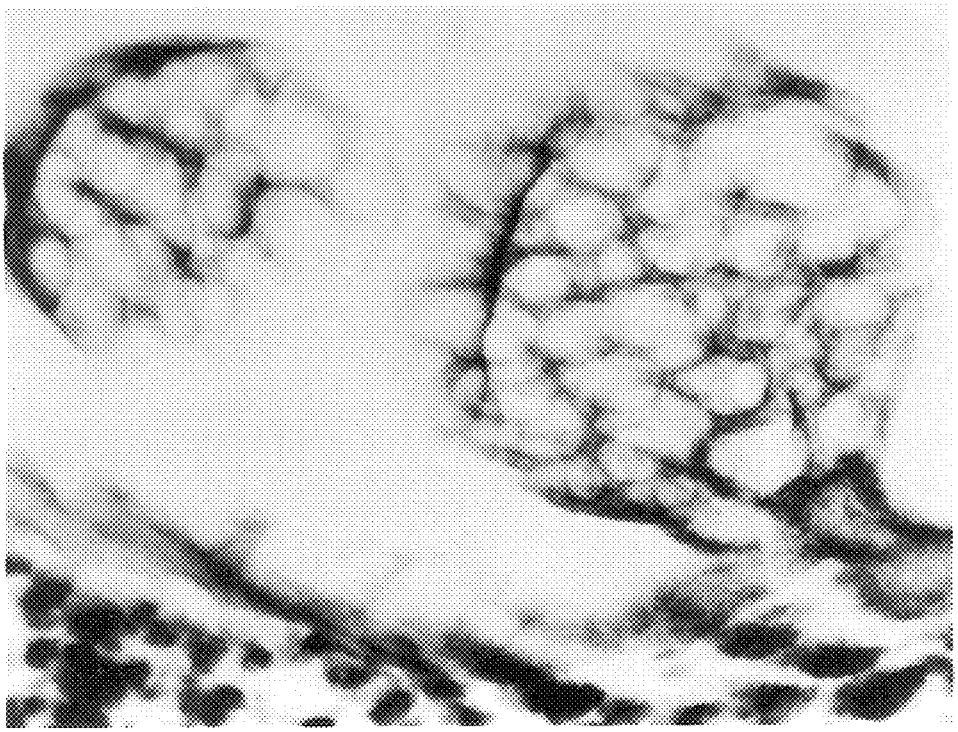
FIG. 14 is a TEM photograph corresponding to but at a larger magnification than FIG. 13.

As shown in FIGS. 13 and 14, the SEBS particles dispersively contained in the sealant layer D (lower side of the photograph) and the polybutadiene particles dispersively contained in HIPS of the developer container (upper side of the photograph) were mutually dissolved to be melt-bonded to each other as if the boundary therebetween was destroyed or removed at the seal boundary due to heat and pressure in the heat-sealing.

Figure 15:
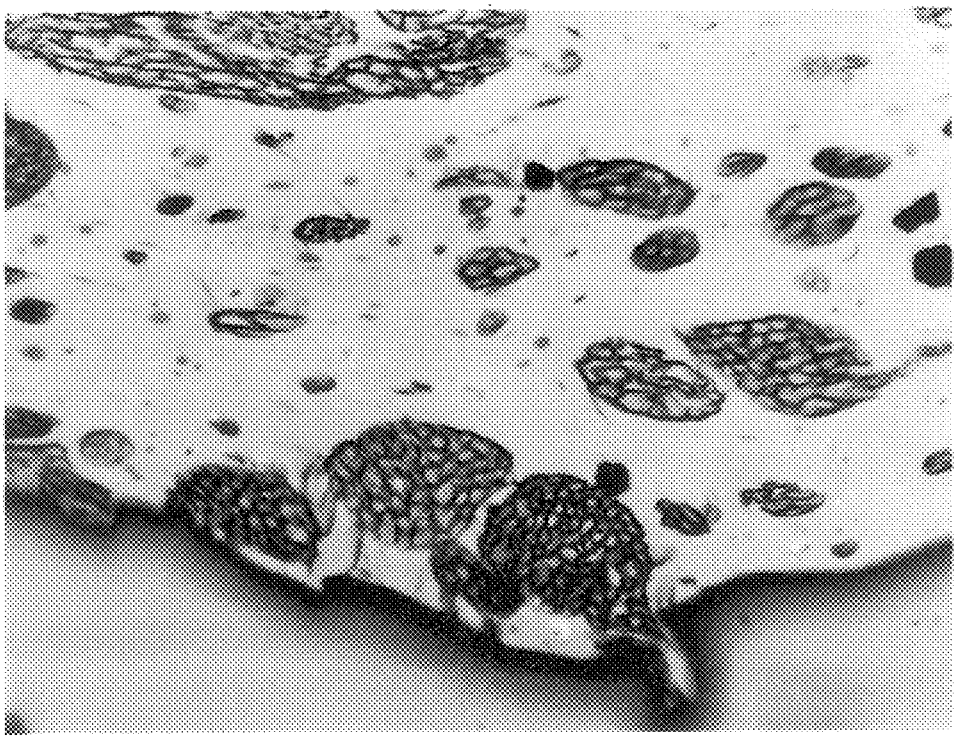
FIG. 15 is a TEM photograph of a sliced sealant layer section after peeling the developer sealing member off the developer container according to Example 1.

After the heat sealing, the sealing member X was peeled apart from the developer container Y, and a portion of the sealing surface S thereafter was sliced for observation of the peeled section through a TEM. FIG. 15 shows a TEM photograph ($\times2\times10^4$) thus obtained.

As shown in FIG. 15, the polybutadiene particles at the seal boundary were left in a stretched state due to the peeling action exerted on the particles mutually dissolved and bonded to the SEBS particles in the sealant layer of the peeled sealing member.

Sealing Performance Evaluation

The sealing performance of a sealed developer container prepared in the above-described manner, after filling with a toner, was evaluated by a circulation (dropping) test, measurement of the seal-breaking strength, and observation of sealant residue.

As the circulation test, a sealed developer container was filled with 500 g of a magnetic toner (weight-average particle size of 7 $\mu$m) through a filling port which was thereafter closed with a cap, then packed in a rectangular box and left standing in an environment of ca. −5° C. for 24 hours. Then, the box was freely dropped from a height of 80 cm totally ten times (including one time for dropping of the box at its corner; three times for dropping at three ridges, respectively, forming the corner; and six times for dropping at six surfaces of the box). Thereafter, the developer container was taken out of the box and it was observed whether this procedure caused toner leakage.

As a result, toner leakage due to sealing failure (peeling of the seal) was not observed, thus establishing a very good sealing performance. The seal showed a seal-breaking strength (180 deg.-peeling strength) of ca. 2.2 kg.f, indicating good processability. After the seal breaking, no sealant residue was observed. Thus, the sealing performance of the seal was evaluated to be very excellent as a whole.

Comparative Example 1

A sealing member was prepared in the same manner as in Example 1 except for omitting SEBS from the sealant layer, and a sealed developer container was prepared by using the sealing member and evaluated otherwise in the same manner as in Example 1.

As a result of the dropping test, toner leakage due to sealing failure (peeling) was observed, thus showing a clearly inferior sealing performance as compared to Example 1.

EXAMPLES 2 AND 3

Sealing members were prepared in the same manner as in Example 1 except for changing the addition amounts of SEBS to 1 wt. % (Example 2) and 29.5 wt. % (Example 3), respectively, of the sealant layer. Then, by using the sealing members otherwise in the same manner as in Example 1, sealed developer containers were prepared and evaluated.

As a result of the dropping test, the sealed developer containers showed no toner leakage due to sealing failure. Further, the developer container showed seal-breaking strengths of 1.5 kg.f and 2.5 kg.f, respectively, thus showing good processability, while leaving no sealant residue. Thus, the overall sealing performances were evaluated to be very excellent similar to Example 1.

EXAMPLE 4

A sealing member was prepared in the same manner as in Example 1 except for the use of styrene-butadiene-styrene copolymer elastomer (SBS) instead of SEBS as the dispersed material in the sealant layer. By using the sealing member otherwise in the same manner as in Example 1, a sealed developer container was prepared and evaluated.

As a result of the dropping test, the sealed developer container showed no toner leakage, thus showing a good seal strength. The seal could be broken at a strength of ca. 2.0 kg.f without leaving sealant residue, thus showing excellent overall sealing performances similar to as in Example 1.

Further, sealing members and sealed developer containers were prepared in the same manner as above except for changing the addition amounts of the SBS to 1.0 wt. % and 29.5 wt. %, respectively, of the sealing layer. As a result of the dropping test, the sealed developer containers showed no toner leakage due to sealing failure. Further, the seals were broken at peeling strengths of 1.4 kg.f and 2.2 kg.f, respectively, thus showing good processability and without leaving sealant residue.

EXAMPLE 5

A sealing member was prepared in the same manner as in Example 1 except for using syndiotactic 1,2-polybutadiene having a crystallinity of 20% instead of SEBS as the dispersed material in the sealant layer. By the use of the sealing member otherwise in the same manner as in Example 1, a sealed developer container was prepared and evaluated.

As a result of the dropping test, the sealed developer container showed no toner leakage, thus showing a good seal strength. The seal could be broken at a strength of ca. 1.9 kg.f without leaving sealant residue, thus showing excellent overall sealing performances similar to Example 1.

Further, sealing members and sealed developer containers were prepared in the same manner as above except for changing the addition amounts of the syndiotactic 1,2-polybutadiene to 1.0 wt. % and 29.5 wt. %, respectively, of the sealing layer. As a result of the dropping test, the sealed developer containers showed no toner leakage due to sealing failure. Further, the seals were broken at peeling strengths of 1.5 kg.f and 2.1 kg.f, respectively, thus showing good processability and without leaving sealant residue.

The seal boundary of each of the sealed developer containers according to Examples 2–5 was observed through a TEM similar to Example 1, whereby it was confirmed that the dispersed particles in the sealant layer and the sealing surface portion of the developer container were mutually dissolved with and bonded to each other in each seal boundary.

EXAMPLE 6

Figure 16:
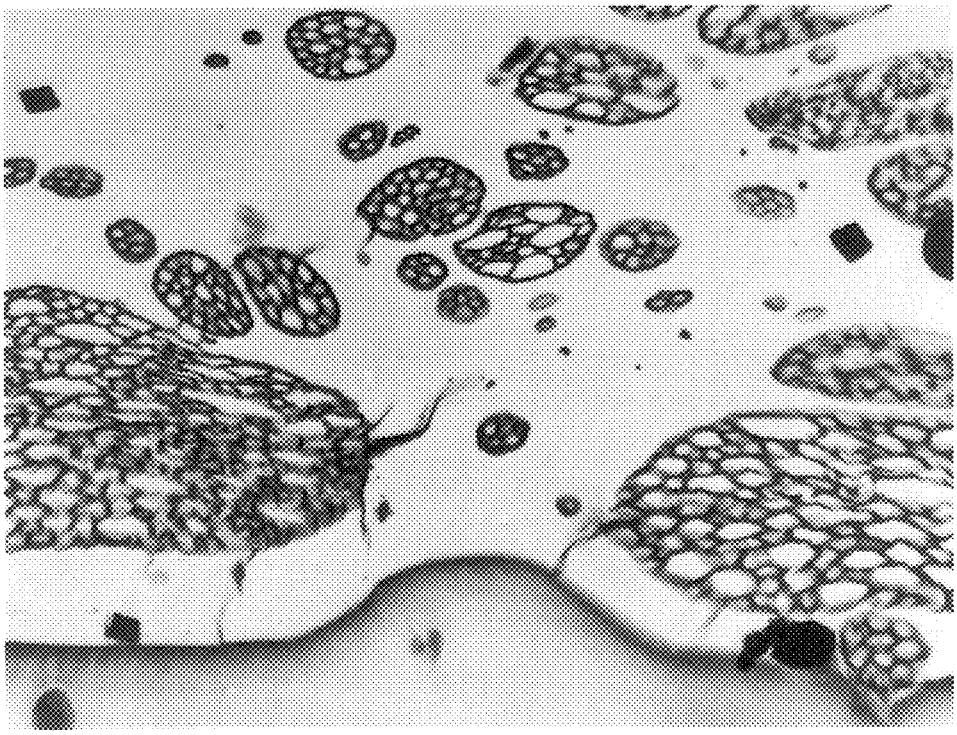
FIG. 16 is a TEM photograph of a sliced section of the developer container of HIPS after the peeling of the sealing member according to Example 6.

A developer container Y was formed similar to Example 1 except that the base HIPS was replaced by HIPS containing polybutadiene particles having an average particle size of 0.75 $\mu$m but in a mixture of larger particles of ca. 3–4 $\mu$m and smaller particles of ca. 0.5–1.5 $\mu$m as shown in FIG. 16 (a TEM photograph at a magnification of $2\times10^4$) dispersed in a not-fully uniform state. By using the developer container otherwise in the same manner as in Example 1, a sealed developer container was prepared and evaluated.

As a result of the dropping test, the sealed developer container showed no toner leakage, thus showing a good seal strength. The seal could be broken at a strength of ca. 1.9 kg.f without leaving sealant residue, thus showing excellent overall sealing performance similar to Example 1.

EXAMPLE 7

A developer container Y was formed similarly to Example 1 except for using acrylonitrile-butadiene-styrene copolymer (ABS) containing polybutadiene particles as dispersed particles having an average particle size of 0.62 $\mu$m instead of HIPS. By using the developer container otherwise in the same manner as in Example 1, a sealed developer container was prepared and evaluated.

As a result of the dropping test, the sealed developer container showed no toner leakage, thus showing a good seal strength. The seal could be broken at a strength of ca. 2.1 kg.f without leaving sealant residue, thus showing excellent overall sealing performances similar to Example 1.

EXAMPLE 8

A developer container Y was formed similar to Example 1 except for the use of acrylonitrile-butadiene-styrene copolymer (PC-ABS) containing polybutadiene particles as dispersed particles having an average particle size of 0.60 $\mu$m instead of HIPS. By using the developer container otherwise in the same manner as in Example 1, a sealed developer container was prepared and evaluated.

As a result of the dropping test, the sealed developer container showed no toner leakage, thus showing a good seal strength. The seal could be broken at a strength of ca. 2.1 kg.f without leaving sealant residue, thus showing excellent overall sealing performances similar to Example 1.

The seal boundary of each of the sealed developer containers according to Examples 6–8 was observed through a TEM similar to Example 1, whereby it was confirmed that the dispersed particles in the sealant layer and the sealing surface portion of the developer container were mutually dissolved with and bonded to each other in each seal boundary.

Comparative Example 2

A developer container Y was formed similar to Example 1 except for using polystyrene PS containing no dispersed particles instead of HIPS. By using the developer container otherwise in the same manner as in Example 1, a sealed developer container was prepared and evaluated.

As a result of the dropping test, the sealed developer container caused toner leakage due to sealing failure (peeling), thus showing clearly inferior sealing performance.

EXAMPLE 9

Figure 17:
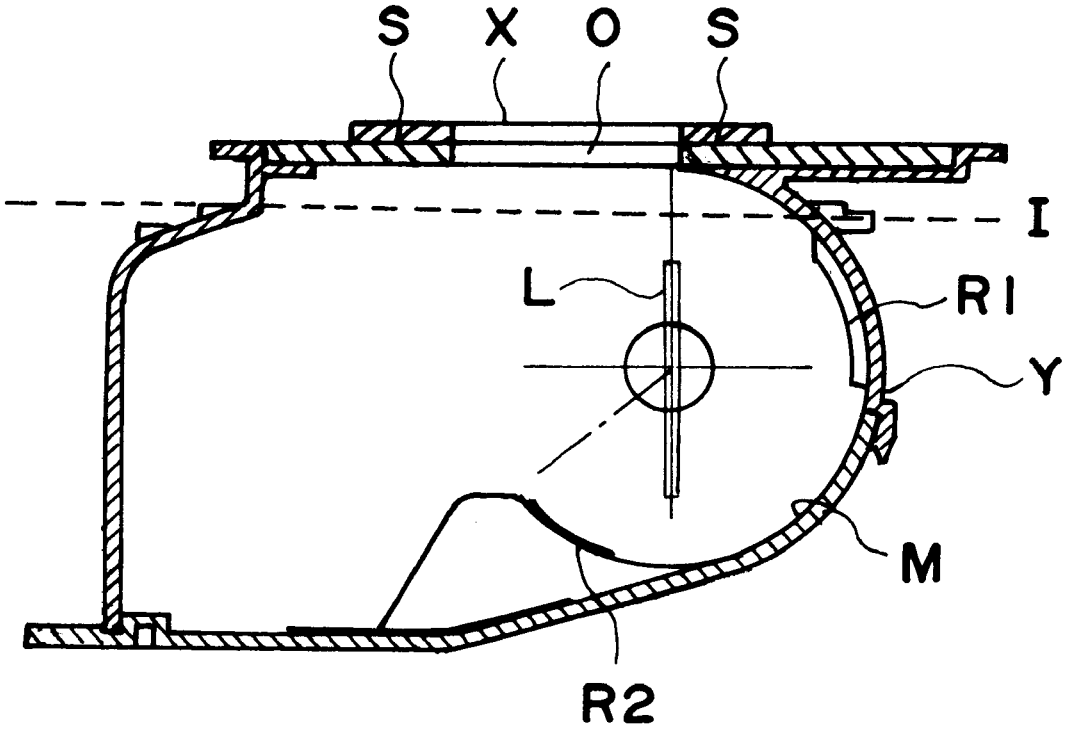
FIG. 17 is a sectional view of a developer container prepared in Example 9.

A developer container Y having a sectional structure as shown in FIG. 17 including a contour M adapted for rotation of a toner-stirring bar L and having an opening O as shown in JP-B 2-38377 not suitable for directly supporting a sealing pressure with a surface opposite to the sealing surface S was formed of the same HIPS composition as in Example 1 by a die slide molding method. The connecting plane for the die slide molding method is indicated by "I", and the developer container was provided with optical monitor windows R1 and R2 for detection of the toner residual amount in the container. The opening of the developer container was sealed with a sealing member having a laminate structure identical to the one used in Example 1 under heat-sealing conditions of a sealing temperature of 150° C., a sealing pressure of 5 kg.f/cm$^2$ and a sealing time of 3.5 sec. which were characterized as a lower temperature, a longer sealing time and a lower pressure to minimize the deformation as the container structure did not allow direct support of the sealing pressure at the opposite surface.

The thus-prepared sealed developer container was evaluated with respect to sealing performances in the same manner as in Example 1.

As a result of the dropping test, the sealed developer container showed no toner leakage, thus showing a good seal strength. The seal could be broken at a strength of ca. 2.2 kg.f without leaving sealant residue, thus showing excellent overall sealing performances similar to Example 1.

Comparative Example 3

A sealing member was prepared in the same manner as in Example 1 except for omitting SEBS from the sealant layer, and a sealed developer container was prepared by using the sealing member and evaluated otherwise in the same manner as in Example 9.

As a result of the dropping test, toner leakage due to sealing failure (peeling) was observed, thus showing a clearly inferior sealing performance than in Example 9.

Further Modifications

In the above-mentioned Examples, both the sealant layer of the sealing member and the developer-container constituting material contained butadiene-containing elastomers as dispersed materials so as to satisfy the mutual solubility requirement. However, this requirement is also satisfied by using isoprene-containing elastomers or ethylene-propylene copolymer-based elastomers in both the sealant layer and the developer container.

In the above-mentioned examples, the dispersed material was dispersed in the entire developer container but can be dispersed only in the vicinity of the sealing surface or in a separately formed flange part which is then integrated with a main container body.

EXAMPLE 10

A sealing member having a laminate structure identical to that of the sealing member in Example 1 was prepared except for forming the sealant layer of 40 $\mu$m in thickness of a composition comprising EVA (vinyl acetate content=7 wt. %) having a GPC molecular weight distribution showing no peak at below $10^5$ and a single peak at $1.54\times10^5$, and 3.0 wt. % based on the sealant layer of hydrogenated SBS copolymer as the dispersed material.

The sealing member was prepared by first forming a laminate of the substrates A and B, and then bonding the laminate and the sealant layer D with a melted cushioning layer C.

Separately, a developer container Y having a structure identical to the one formed in Example 1 was formed by injection molding of HIPS of UL-flame-retarding grade V2 containing 1.1 wt. % of stearic acid salt and containing polybutadiene particles in a mixture of larger particles of 3–4 $\mu$m and smaller particles of 0.5 to 1.5 $\mu$m dispersed in a not-fully uniform state.

The opening of the developer container Y was sealed with the above-prepared sealing member under identical heat sealing conditions to prepare a sealed developer container, which was evaluated with respect to sealing performances in the same manner as in Example 1.

As a result of the dropping test, the sealed developer container showed no toner leakage, thus showing a good seal strength. The seal could be broken at a strength of ca. 2.0 kg.f without leaving sealant residue, thus showing excellent overall sealing performance.

EXAMPLE 11

A sealing member was prepared in the same manner as in Example 10 except for the use of hydrogenated styrene-isoprene-styrene copolymer elastomer (SIS) instead of hydrogenated SBS copolymer elastomer as the dispersed material in the sealant layer. By using the sealing member otherwise in the same manner as in Example 10, a sealed developer container was prepared and evaluated.

As a result of the dropping test, the sealed developer container showed no toner leakage, thus showing a good seal strength. The seal could be broken at a strength of ca. 2.1 kg.f without leaving sealant residue, thus showing excellent overall sealing performances similar to Example 10.

EXAMPLE 12

A sealing member was prepared in the same manner as in Example 10 except for using an olefin-type elastomer comprising a hard segment of PE and a soft segment of hydrogenated PS-butadiene rubber instead of the hydrogenated SBS copolymer elastomer as the dispersed material in the sealant layer. By using the sealing member otherwise in the same manner as in Example 10, a sealed developer container was prepared and evaluated.

As a result of the dropping test, the sealed developer container showed no toner leakage, thus showing a good seal strength. The seal could be broken at a strength of ca. 1.9 kg.f without leaving sealant residue, thus showing excellent overall sealing performance similar to Example 10.

EXAMPLE 13

A sealing member was prepared in the same manner as in Example 10 except for the use of a urethane-type elastomer comprising a hard segment of urethane unit and a soft segment of polyester instead of the hydrogenated SBS as the dispersed material in the sealant layer. By using the sealing member otherwise in the same manner as in Example 10, a sealed developer container was prepared and evaluated.

As a result of the dropping test, the sealed developer container showed no toner leakage, thus showing a good seal strength. The seal could be broken at a strength of ca. 1.8 kg.f without leaving sealant residue, thus showing excellent overall sealing performance similar to Example 10.

EXAMPLE 14

A sealing member was prepared in the same manner as in Example 10 except for the use of an ester-type elastomer comprising a hard segment of polyester and a soft segment of polyether instead of the hydrogenated SBS as the dispersed material in the sealant layer. By using the sealing member otherwise in the same manner as in Example 10, a sealed developer container was prepared and evaluated.

As a result of the dropping test, the sealed developer container showed no toner leakage, thus showing a good seal strength. The seal could be broken at a strength of ca. 1.8 kg.f without leaving sealant residue, thus showing excellent overall sealing performance similar to Example 10.

EXAMPLE 15

A sealing member was prepared in the same manner as in Example 10 except for the use of an amide-type copolymer comprising a hard segment of polyamide and a soft segment of polyether instead of the hydrogenated SBS as the dispersed material in the sealant layer. By using the sealing member otherwise in the same manner as in Example 10, a sealed developer container was prepared and evaluated.

As a result of the dropping test, the sealed developer container showed no toner leakage, thus showing a good seal strength. The seal could be broken at a strength of ca. 1.7 kg.f without leaving sealant residue, thus showing excellent overall sealing performances similarly as in Example 10.

EXAMPLE 16

A sealing member was prepared in the same manner as in Example 10 except for increasing the amount of the hydrogenated SBS to 30.0 wt. % of the sealant layer.

Further, a developer container was formed of the same material in a similar structure as in Example 10 but in an ultra-large size of an inner volume of 3000 cc for filling with 1.5 kg of magnetic toner and an opening width of 100 mm.

A sealed developer container was prepared by sealing the opening of the developer container with the above-prepared sealing member otherwise in a similar manner as in Example 10 and evaluated in the same manner as in Example 10.

As a result of the dropping test, the sealed developer container showed no toner leakage, thus showing a good sealing strength. The seal was broken at an increased strength of ca. 3.5 kg in spite of a similar seal pattern as in Example 10, thus showing a somewhat lower processability, but no sealant residue was left.

Further, sealed developer containers were prepared in similar manners as in Examples 11 to 15 except for the use of an increased amount of dispersed elastomer material in the sealant layer for sealing an ultra-large size developer container similar to Example 16 above, whereby the resultant sealed developer containers of an ultra-large size showed a similarly good seal strength but a somewhat lower processability.

As is understood from the above results, even an ultra-large size developer container can be satisfactorily sealed with an increased seal strength if the amount of the dispersed thermoplastic elastomer material in the sealant layer is increased but also accompanied with a somewhat lower processability. Accordingly, the amount of the thermoplastic elastomer should be appropriately be selected corresponding to the opening width and inner volume of the container and the amount of the developer to be contained.

More specifically, the amount of the thermoplastic elastomer should preferably be selected within the range of 0.1–30.0 wt. %, further preferably 0.5–30.0 wt. %, of the sealant layer.

EXAMPLE 17

A sealed developer container prepared in the same manner as in Example 10 was loaded on an image forming apparatus, and the seal thereof was broken to discharge the developer contained therein. The developer container was checked with respect to the re-utilizability thereof by cleaning of and re-sealing on the same sealing surface, followed by re-filling of the developer.

First of all, the developer container after use was cleaned sufficiently by air-blowing with greater attention to the sealing surface. Then, the sealing surface depression was again measured to be a small value of 10 $\mu$m.

Then, onto the same sealing surface position of the developer container, a sealing member identical to the one prepared in Example 10 was applied by heat-sealing under the same heat-sealing conditions as in Example 10.

The thus-resealed developer container was re-filled with a toner through the filling port, which was then closed with a cap. Then, the thus-formed re-sealed developer container was again evaluated with respect to the sealing performances similarly as in Example 10.

As a result of the dropping test, the re-sealed developer container showed no toner leakage, thus showing a good seal strength. The seal could be broken at a strength of ca. 2.1 kg.f similar to that after the first sealing, without leaving sealant residue, thus showing excellent overall sealing performances similarly as after the first sealing in Example 10.

As a result of repetitive tests, it was confirmed that, if the sealing surface depression in the first sealing was suppressed to at most 50 $\mu$m, the re-sealed developer containers were free from toner leakage due to sealing failure when subjected to the dropping test, and identical processability as represented by an identical seal-breaking strength could be obtained, so that similar good overall sealing performances could be obtained regardless of the material of the developer containers.

Comparative Example 4

A re-sealing test was performed similar to Example 17 except that the heat-sealing conditions for the first and re-sealing were changed to a temperature of 160° C., a sealing pressure of 22 kg.f and a sealing time of 3.5 sec. so as to provide a sealing surface depression of 100 $\mu$m.

The thus re-sealed developer container was evaluated with respect to sealing performances similar to Example 10 but found to have caused toner leakage due to sealing failure as a result of the dropping test. It was supposed to be because, while the sealing surface fitting was adjusted at the time of the re-sealing, a locally insufficient fitting or insufficient sealing pressure occurred inevitably due to the sealing surface depression at the first sealing which amounted to 100 $\mu$m.

What is claimed is:

1. A sealed developer container for containing a developer, comprising:

a developer container having an opening and a sealing surface portion surrounding the opening; and a sealing member having a sealant layer and applied onto the sealing surface portion of the developer container with the sealant layer, wherein the sealant layer contains a dispersed material therein and the sealing surface portion of the developer container contains a dispersed material, which is mutually soluble with the dispersed material in the sealant layer.

2. The developer container according to claim 1, wherein the dispersed material in the sealant layer comprises a thermoplastic elastomer.

3. The developer container according to claim 2, wherein said thermoplastic elastomer is a member selected from the group consisting of styrene elastomer, olefin elastomer, urethane elastomer, ester elastomer and amide elastomer.

4. The developer container according to claim 2, wherein said dispersed material in the sealing surface portion of the developer container comprises a polymerized chemical species identical to that providing a soft segment of the thermoplastic elastomer in the sealant layer.

5. The developer container according to claim 4, wherein said dispersed material in the sealing surface portion of the developer container comprises polymerized butadiene units and said dispersed material in the sealant layer comprises a thermoplastic elastomer having a soft segment comprising polymerized buradiene units.

6. The developer container according to claim 5, wherein said thermoplastic elastomer in the sealant layer comprises a styrene elastomer having a hard segment comprising polymerized styrene units and a soft segment comprising polymerized butadiene units.

7. The developer container according to claim 6, wherein said thermoplastic elastomer is a styrene butadiene-styrene block copolymer or a styrene-ethylene-butadiene-styrene block copolymer.

8. The developer container according to claim 1, wherein said sealant layer comprises a thermoplastic resin, and the dispersed material is dispersed in the thermoplastic resin.

9. The developer container according to claim 8, wherein said thermoplastic resin comprises at least one member selected from polyethylene and ethylene-vinyl acetate copolymer.

10. The developer container according to claim 1, wherein said dispersed material is contained in a proportion of 0.5–30 wt. % of the sealant layer.

11. The developer container according to claim 1, wherein said developer container is formed of a resin selected from the group consisting of impact-resistant polystyrene (HIPS), acrylonitrile-butadiene-styrene copolymer (ABS), or polycarbonate/acrylonitrile-butadiene-styrene copolymer (PC-ABS).

12. The developer container according to claim 1, wherein the dispersed material in the sealant layer and the dispersed material in the sealing surface portion of the developer container are connected in a mutually dissolved state at a sealing boundary between the sealant layer and the sealing surface of the developer container.

13. The developer container according to claim 12, wherein the sealing member has been applied by heat-pressure bonding onto the sealing surface of the developer container.

14. The developer container according to claim 12, wherein said sealing member is applied to the sealing surface portion of the developer container in an easily peelable state.

15. The developer container according to claim 12, wherein said sealing member is half-cut so as to allow the peeling of a portion thereof covering the opening of the developer container.

16. A process cartridge detachably mountable to a main assembly of an image forming apparatus, including at least a sealed developer container containing a developer, said selected developer container comprising:

a developer container having an opening and a sealing surface portion surrounding the opening; and a sealing member having a sealant layer and applied onto the sealing surface portion of the developer container with the sealant layer, wherein the sealant layer contains a dispersed material therein and the sealing surface portion of the developer container contains a dispersed material which is mutually soluble with the dispersed material in the sealant layer.

17. A method of sealing a developer container for containing a developer, comprising the steps of:

providing a sealing member having a sealant layer containing a dispersed material therein;

providing a developer container having an opening and a sealing surface portion surrounding the opening, the sealing surface portion containing a dispersed material which is mutually soluble with the dispersed material in the sealant layer of the sealing material; and applying the sealing member with its sealant layer onto the sealing surface portion of the developer container so as to cover the opening of the developer container under application of a sealing pressure onto the sealing surface portion of the developer container via the sealing member while not supporting the sealing pressure at a surface opposite to the sealing surface portion of the developer container.

18. The method according to claim 17, wherein said developer container has its sealing surface portion positioned horizontally inside an outer contour thereof, and also an inner contour having a sectional shape of a partial circle corresponding to a moving track of a developer stirring means is provided therein.

19. A sealing member for sealing an opening of a developer container for containing a developer therein, comprising a sealant layer which comprises a thermoplastic resin and a thermoplastic elastomer dispersed in the thermoplastic resin.

20. The sealing member according to claim 19, wherein said thermoplastic elastomer is a member selected from the group consisting of styrene elastomer, olefin elastomer, urethane elastomer, ester elastomer and amide elastomer.

21. The sealing member according to claim 19, wherein said thermoplastic elastomer is a member selected from the group consisting of styrene-butadiene-styrene block copolymer, styrene-ethylene-butadiene-styrene block copolymer, and syndiotactic 1,2-polybutadiene.

22. The sealing member according to claim 19, wherein said thermoplastic resin comprises at least one member selected from polyethylene and ethylene-vinyl acetate copolymer.

23. The sealing member according to claim 19, wherein said thermoplastic elastomer is contained in a proportion of 0.5–30 wt. % of the sealant layer.

24. A method of re-utilizing a developer container for containing a developer therein, comprising the steps of:

providing a developer container having an opening and a sealing surface portion surrounding the opening;

providing a sealing member having a sealant layer containing a thermoplastic elastomer dispersed therein;

applying the sealing member onto the sealing surface portion of the developer container under application of a sealing pressure onto the sealing surface via the sealing member in a first sealing step to provide a sealed developer container filled with a developer;

cleaning the sealing surface after removing the sealing member for discharging the developer contained therein; and again applying a similar sealing member onto the cleaned sealing surface of the developer container under application of a sealing pressure in a subsequent sealing step, wherein the first sealing step is performed while controlling the sealing pressure to provide a sealing surface depression within a range of 5–50 $\mu$m.

* * * * *

UNITED STATES PATENT AND TRADEMARK OFFICE

CERTIFICATE OF CORRECTION

PATENT NO. : 6,097,907

DATED : August 1, 2000

INVENTOR(S): YASUO FUJIWARA

It is certified that error appears in the above-identified patent and that said Letters Patent is hereby corrected as shown below:

COLUMN 1:
Line 18, "a" should be deleted.

COLUMN 2:
Line 56, "material," should read --material;--.

COLUMN 4:
Line 28, "to but" should read --to, but--.

COLUMN 6:
Line 2, "preferable" should read --preferably--.
Line 15, "uniformize" should read --make uniform--.

COLUMN 8:
Line 37, "container Y" should read –container Y,--; and "on" should read –of--.

COLUMN 11:
Line 10, "very" should be deleted.
Line 24, "as in" should be deleted.
Line 36, "using" should read –the use of--.
Line 38, "the use of" should read –using--.
Line 47, "performances" should read –performance--.

COLUMN 12:
Line 15, "similarly" should read –similar--.

UNITED STATES PATENT AND TRADEMARK OFFICE

CERTIFICATE OF CORRECTION

PATENT NO. : 6,097,907

DATED : August 1, 2000

INVENTOR(S): YASUO FUJIWARA

It is certified that error appears in the above-identified patent and that said Letters Patent is hereby corrected as shown below:

COLUMN 14:
Line 27, "performances" should read –performance--.

COLUMN 15:
Line 19, "performances similarly as in" should read –performance similar to--.
Line 54, "be" (2nd occurrence) should be deleted.

COLUMN 17:
Line 19, "styrene butadiene-styrene" should read –styrene-butadiene-styrene--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*